US009642406B2

(12) United States Patent
Kusjanovic

(10) Patent No.: US 9,642,406 B2
(45) Date of Patent: May 9, 2017

(54) GLOVE PROVIDING GRIP AND DEXTERITY

(76) Inventor: Henry James Kusjanovic, Armonk, NY (US)

( * ) Notice: Subject to any disclaimer, the term of this patent is extended or adjusted under 35 U.S.C. 154(b) by 912 days.

(21) Appl. No.: 13/398,766

(22) Filed: Feb. 16, 2012

(65) Prior Publication Data

US 2013/0212775 A1 Aug. 22, 2013

(51) Int. Cl.
*A41D 19/00* (2006.01)
*A41D 19/015* (2006.01)

(52) U.S. Cl.
CPC ... *A41D 19/01547* (2013.01); *A41D 19/0013* (2013.01)

(58) Field of Classification Search
CPC ..... A41D 19/015; A41D 19/01547; A41D 19/0013; A41D 19/0017
USPC ..... 2/164, 163, 159, 168, 161.8, 21, 158, 2/160, 16, 161.1, 161.2, 162, 161.7, 2/161.3, 161.6
See application file for complete search history.

(56) References Cited

U.S. PATENT DOCUMENTS 2,118,463 A * 5/1938 Eden ..... 2/163
2,335,320 A * 11/1943 Swietek ..... 2/163
4,197,592 A 4/1980 Klein
4,416,026 A 11/1983 Smith
4,441,213 A 4/1984 Trumble et al.
4,507,807 A 4/1985 Karkanen
4,733,412 A 3/1988 Campbell
5,022,094 A 6/1991 Hames et al.
5,423,089 A 6/1995 Chun et al.
5,467,484 A 11/1995 Drescher et al.
5,548,844 A * 8/1996 Ceresia ..... 2/161.7
5,687,424 A 11/1997 Masley
5,774,895 A 7/1998 Baldwin
5,829,061 A 11/1998 Visgil et al.
5,881,388 A 3/1999 Pratt
5,924,137 A * 7/1999 Gold ..... 2/161.1
6,029,276 A 2/2000 White
6,044,494 A 4/2000 Kang
6,704,939 B2 3/2004 Faulconer
6,912,731 B2 7/2005 Cass
7,159,246 B2 1/2007 Tippey
7,735,153 B1 * 6/2010 Romiti ..... 2/163
2005/0231471 A1 10/2005 Mallard et al.
2006/0156451 A1 7/2006 Klein et al.
2009/0000010 A1 * 1/2009 Sunder et al. ..... 2/163
2009/0275418 A1 11/2009 Whitehead, II et al.
2011/0030121 A1 2/2011 Smalls
(Continued)

*Primary Examiner* — Khaled Annis
(74) *Attorney, Agent, or Firm* — McCarter & English, LLP

(57) ABSTRACT

A glove that provides finger dexterity and grip while keeping the wearer's hands warm. The glove includes an exposed tight inner layer on the palm side of the fingertips to provide a good gripping surface with the glove on. The only exposed portion of the tight layer may be on the side of the finger where there are fingerprints—the palm side. The back side of the glove, where the fingernails and knuckles are, may be covered by a normal glove. The outer layer is cut out on the palm side and attached to the tight layer along the edge of the palm of the hand. The tight layer of the glove could either only be on the fingertips, or could be tight on the entire palm side of the glove to expose the whole palm to the gripping surface. This may require the tight inner lining around the whole hand.

8 Claims, 1 Drawing Sheet

(56) References Cited

U.S. PATENT DOCUMENTS

2011/0078841 A1 4/2011 Ketelsen
2011/0314588 A1* 12/2011 Gaskins ..... 2/160

* cited by examiner

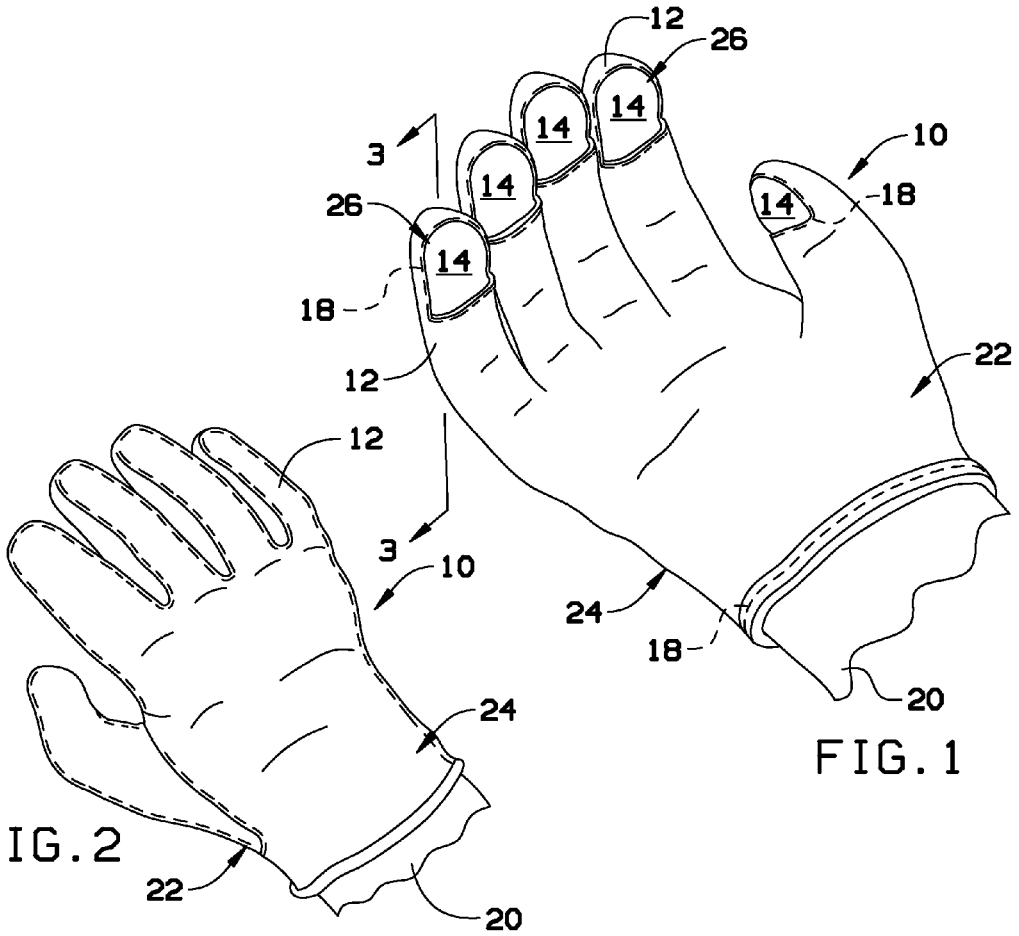
FIG. 1
FIG. 2
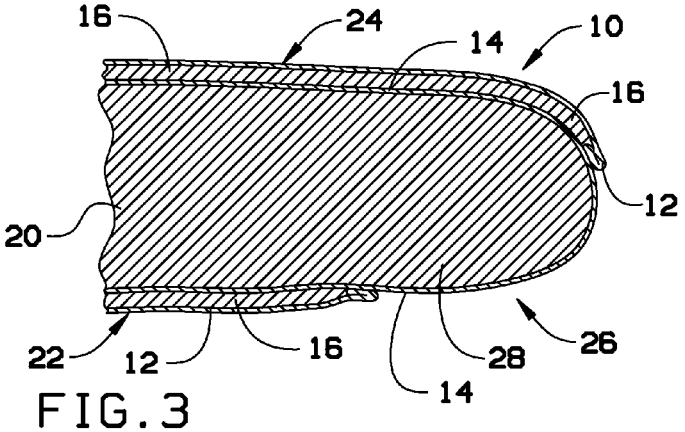
FIG. 3

GLOVE PROVIDING GRIP AND DEXTERITY

BACKGROUND OF THE INVENTION

The present invention relates to gloves and, more particularly, to gloves that provide better grip and finger dexterity while keeping hands warm.

People often have to tie their shoes or press small buttons with gloves on, which can prove difficult. Typically, people need to remove their gloves to perform such tasks which, in cold weather, can be quite uncomfortable. For example, while outside in the cold, gloves have to be removed all the time for simple tasks such as buttoning buttons or getting money from pockets or a wallet. One other option is for the user to wear thin gloves, but such gloves may not be appropriate for cold weather, especially if the gloves are thin enough to provide the needed finger dexterity.

As can be seen, there is a need for an improved glove that provides grip and finger dexterity while keeping hands warm.

SUMMARY OF THE INVENTION

In one aspect of the present invention, a glove comprises an outer glove lining covering the hand, fingers and thumb of a user; and an inner glove lining attached to the outer glove lining at least in a palm-side fingertip and thumb tip region thereof, wherein the outer glove lining having an opening on the palm-side fingertip and thumb tip region of the glove, exposing the inner glove lining.

In another aspect of the present invention, a glove comprises an outer glove lining covering the hand, fingers and thumb of a user; stitching about opening, the stitching joining the inner glove lining with the outer glove lining; insulation between the outer glove lining and the inner glove lining, and an inner glove lining attached to the outer glove lining at least in a palm-side fingertip and thumb tip region thereof, wherein the outer glove lining having an opening on the palm-side fingertip and thumb tip region of the glove, exposing the inner glove lining.

These and other features, aspects and advantages of the present invention will become better understood with reference to the following drawings, description and claims.

BRIEF DESCRIPTION OF THE DRAWINGS

FIG. 1 is a palm-side perspective view of a glove according to an exemplary embodiment of the present invention;

FIG. 2 is a back-hand side perspective view of the glove of FIG. 1; and

FIG. 3 is a cross-sectional view taken along line 3-3 of FIG. 1.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a glove that provides finger dexterity and grip while keeping the wearer's hands warm. The glove includes an exposed tight inner layer on the palm side of the fingertips to provide a good gripping surface with the glove on. The only exposed portion of the tight layer may be on the side of the finger where there are fingerprints—the palm side. The back side of the glove, where the fingernails and knuckles are, may be covered by a normal glove. The outer layer is cut out on the palm side and attached to the tight layer along the edge of the palm of the hand. The tight layer of the glove could either only be on the fingertips, or could be tight on the entire palm side of the glove to expose the whole palm to the gripping surface. This may require the tight inner lining around the whole hand.

Normal gloves have one consistent clumsy layer around the hand and fingers such as leather, for example. Embodiments of the present invention provides a leather (or any type of material) glove to have fingertips that can perform tasks that would require a form fitting glove, like a batting glove, around the fingertips. By having the warmth of a normal glove on the entire hand, except for the palm side of the fingertips, the hand is not exposed enough to make it cold. The glove also appears like a normal glove from the back side so the style is not diminished. The thin material for the palm side of the fingertips may be a thin, insulated material, such as Gore-Tex™ or the like to provide extra warmth for the fingertips.

Referring now to FIGS. 1 through 3, a glove 10 may have an outer glove lining 12 and an inner glove lining 14 with insulation 16 therebetween. An opening 26 in the outer glove lining 12 may expose the inner glove lining 14 at the palm side fingertip and thumb tip region thereof. Stitching 18 may be applied around the opening 26 to help ensure a tight fit of the inner glove lining 14 at the palm side fingertip and thumb tip regions.

As discussed above, a back hand side 24 of the glove 10 may appear as a normal glove. However, a palm side 22 of the glove 10 may have openings 26 cut out on the palm side 22 area of the tips of the fingers 28 of the wearer 20.

This opening 26 may be large enough to provide a good grip and finger dexterity for the wearer 20. However, the opening 26 may not be so large as to cause the wearer's hands to become cold. The opening 26 may, for example, extend from a fingertip to the first joint of each finger. Typically, the opening 26 may expose a fingerprint area of the wearer's fingers such that a tight-fitting inner glove lining 14 may only cover this area.

In some embodiments, the opening 26 may include other regions of the palm side 22 of the glove. For example, the opening 26 may be included in the user's palm to provide a gripping area. As with the fingertips, the inner glove lining 14 may tightly cover the opening 26. In some embodiments, the opening 26 may encompass the entire palm side 22 of the glove 10.

The outer glove lining 12 of the glove 10 may be any typical glove material. For example, the glove may be a leather glove, a ski glove, a cotton glove, or the like.

In some embodiments, the present invention may be applied to a mitten, where a fingertip area of the mitten and a thumb tip area of the mitten has an opening to reveal a thin inner layer.

It should be understood, of course, that the foregoing relates to exemplary embodiments of the invention and that modifications may be made without departing from the spirit and scope of the invention as set forth in the following claims.

What is claimed is:

1. A glove comprising:

an outer glove lining adapted to cover a hand, fingers and a thumb of a user; and an inner glove lining attached to the outer glove lining at least in a palm-side fingertip and a thumb tip region thereof, wherein the outer glove lining includes an opening only at an entire fingerprint area on the palm-side fingertip and the thumb tip region of the glove exposing the inner glove lining only at the entire fingerprint area, wherein the inner glove lining is joined to the outer glove lining around the opening on the palm-side fingertip and the thumb tip region of the glove, and wherein the inner glove lining is joined to the outer glove lining such that the inner glove lining is exposed through the opening of the outer glove lining, the exposed inner glove lining acting as a gripping surface to provide finger dexterity to the user.

2. The glove of claim 1, further comprising insulation between the outer glove lining and the inner glove lining.

3. The glove of claim 1, wherein the inner glove lining is adapted to fit tightly to the fingers and the thumb inserted into the glove.

4. The glove of claim 1, wherein the inner glove lining is joined to the outer glove lining around a perimeter of the opening on the palm-side fingertip and the thumb tip region of the glove.

5. The glove of claim 1, wherein the inner glove lining is joined to the outer glove lining around the opening on the palm-side fingertip and the thumb tip region of the glove with stitching.

6. A glove comprising:

an outer glove lining adapted to cover a hand, fingers and a thumb of a user; and an inner glove lining attached to the outer glove lining at a palm-side fingertip and a thumb tip region thereof, wherein the outer glove lining includes an opening on the palm-side fingertip and the thumb tip region of the glove exposing the inner glove lining, wherein the inner glove lining is located only at the palm-side fingertip and the thumb tip region of the outer glove lining, wherein the inner glove lining is joined to the outer glove lining around the opening on the palm-side fingertip and the thumb tip region of the glove, and wherein the inner glove lining is joined to the outer glove lining such that the inner glove lining is exposed through the opening of the outer glove lining, the exposed inner glove lining acting as a gripping surface to provide finger dexterity to the user.

7. The glove of claim 6, wherein the inner glove lining is adapted to fit tightly to the fingers and the thumb inserted into the glove.

8. The glove of claim 6, wherein the opening is disposed only on the palm-side fingertip and thumb tip region of the glove.

* * * * *